US005356334A

United States Patent [19]

Gray

[11] Patent Number: 5,356,334

[45] Date of Patent: Oct. 18, 1994

[54] APPARATUS AND METHOD FOR AIRBORNE PARTICULATE BOOTH

[75] Inventor: R. David Gray, Plano, Tex.

[73] Assignee: Binks Manufacturing Company, Franklin Park, Ill.

[21] Appl. No.: 955,390

[22] Filed: Oct. 1, 1992

[51] Int. Cl.[5] ..... B05B 15/12

[52] U.S. Cl. ..... 454/51; 454/53

[58] Field of Search ..... 454/50, 51, 53, 61

[56] References Cited

U.S. PATENT DOCUMENTS

| | | | |
|---|---|---|---|
| 3,518,814 | 7/1970 | Maynard | 454/49 X |
| 3,596,671 | 8/1977 | Scharfenberger | 454/90 X |
| 4,303,417 | 12/1981 | Koch, II | 454/53 X |
| 4,342,133 | 8/1982 | Minton | 15/339 |
| 4,724,245 | 3/1988 | Osawa et al. | 454/52 |
| 4,921,504 | 5/1990 | Maclin | 55/104 |
| 5,095,811 | 3/1992 | Shutic et al. | 454/52 |

*Primary Examiner*—Harold Joyce
*Attorney, Agent, or Firm*—Juettner Pyle Lloyd & Piontek

[57] ABSTRACT

Apparatus and method for an airborne particulate booth, such as a dust or paint, include a velocity sensing device for detecting the velocity of the air flow in the booth, utilizing, in a preferred form, a pendulum mounted sail. The air flow from the booth moves the sail; the sail moves the pendulum; and the pendulum's motion is detected and used to control the booth's air flow intake and exhaust fans or blowers to maintain the air flow at essentially a preset or desired constant velocity. Additionally, the apparatus and method when used in a powder paint booth with powder filters, includes progressive pulsing means which pulse the powder filters in a manner such that the interval between pulses may be automatically and progressively changed to keep the powder filters operating at or near peak efficiency from the time they are installed until the time they can no longer be kept functioning efficiently by pulsing, but must be replaced. Additionally, an alarm or warning device can be provided to indicate that the filters must be replaced soon and/or at a future time the booth shut down.

6 Claims, 8 Drawing Sheets

APPARATUS AND METHOD FOR AIRBORNE PARTICULATE BOOTH

This invention relates to airborne particulate booths, and more particularly to such booths where air flow is used therein for controlling the particulate formed therein, be it powder or liquid, and in powder booths, to the powder recovery therefor.

BACKGROUND OF THE INVENTION

It is known in the art to use air flow in a paint booth to control the flow of the excess paint, be it liquid drops or powder particulate, which is discharged from the paint source, such as an atomizer or paint or spray gun, etc., and not actually applied to the articles being painted. It is also known to attempt to control the velocity of the air flow in the booth and/or to try to keep the air flow velocity constant to provide a consistent environment for painting. For example, U.S. Pat. No. 5,095,811 teaches measuring the air flow velocity in a powder paint booth and adjusting the incoming air volume to keep the velocity constant in order to compensate for the fact that the articles being painted are moving through the booth and otherwise would have altered the air flow velocity. The actual velocity adjustment in that patent is taught as being accomplished by sensing the air speed and then through a controller adjusting the speed of the air feed and/or air exhaust fans or blowers.

A prior art technique for sensing such paint or powder booth air velocity was by pitot tube. However, over a period of time the narrow pitot tube tended to clog, was not accurate when dirty, and its sensitivity changed and effect the booth's operation.

In a previous wind chill measuring device, a pendulum moving along a scale was used to determine air speed by taking visual readings off a scale. See U.S. Pat. No. 4,091,667.

In powder booths the excess powder not applied to the articles being painted is in the form of airborne particulate, is recovered and collected on the surfaces of cartridge filters. The air is exhausted from the booth and is pulled through the filters to be treated and recirculated or discharged. In other types of dust booths where an airborne particulate is generated, such is by painting, grinding, sanding, or the other repair or work, the particulate is similarly collected or recovered. The powder or particulate as it is collected tends to build up on the filters. Periodically, in order to extend the time between a filter's installation and the time it must be replaced, the filter is pulsed, with some form of vibration, usually in the form of an air blast or "shot" or pulse of compressed air. For example, see U.S. Pat. Nos. 4,770,118 or 4,913,085, which teach in column 8 thereof, that the "pulse duration and intervals can be determined to be different from normal operation values. These factors can also be varied periodically, by self action, which can be accomplished without further ado through an electronic control."

SUMMARY OF THE INVENTION

The invention comprises a method and apparatus for sensing the air flow velocity in a particulate booth, be it dust, powder or liquid paint, and using the same to control the booth's fans or blowers to provide essentially a constant air speed velocity in the booth. The invention is applicable to any such type booth, including, but not limited to, liquid or powder paint booths and dust booths, but for convenience will be described in connection with powder paint booths. The apparatus of the invention includes and the method of the invention utilizes a velocity sensing means comprising an air flow housing with an air flow path there in or through in communication with the booth's work chamber or area. In the preferred embodiment the velocity sensing means includes a pivotally mounted pendulum which carries a sail that is capable of being displaced by the air flow a distinct distance dependent upon the air's velocity and a proximity sensing device to detect the pendulum's displacement, the sensing device being preferably in the form of an electronic analog linear, inductive proximity sensor. The sensor itself does not detect velocity but detects the movement of a metallic component which is carried on and/or a part of the pendulum and is not effected by normal coating or painting operations, solvents, dust and dirt. The air flowing at velocity causes the sail to swing the pendulum with the metallic portion, and the proximity device detects the pendulum's metallic portion's movement, which can then be converted electronically either by analog or digital means into an electrical signal indicative of the sensed velocity. Appropriate velocity standard means is provided to insure proper operation. This standard, likewise, could be digital or analog, and in the latter case, is a potentiometer generated standard to which the signal from the velocity sensor can be compared. That is when the velocity signal and the potentiometer signal match that indicates attainment of the desired velocity, and when the sensor signal is below that indicates the velocity is too low. Of course, the contrary is indicated when the sensor signal is too high. This detected velocity can then be automatically adjusted by raising or lowering the booth's intake and/or exhaust fans or blowers so that the desired velocity as indicated by the standard set by the potentiometer is achieved. Any conventional comparator circuit can be used to make the comparison, and the operation of the fan or blowers is achieved through, for example, a conventional variable speed drive and/or a conventional programmable logic controller. This constant velocity sensing feature of the invention is known as "Constant Air Flow Velocity Control" (CAFVC) which are trademarks of Binks Manufacturing Company. The Constant Air Flow Velocity Control feature provides the following benefits: uniform conditions for carrying out an operation, e.g. such as painting; excellent control of airborne particulate be it dust or liquid droplets; maximum transfer efficiency (such as for painting) from the first day of operation until the time a powder booth's filter cartridges need to be replaced; no need for seasoning of filter cartridges; contains the particulate or powder within the booth due to its ability to automatically adjust to cartridge loading, and low noise levels by providing the lowest fan speeds necessary to achieve the desired constant velocity.

As mentioned above in the dust or powder booths utilizing the present invention, one or more filters or cartridges are provided to form a filter bank, and in the present invention the air pressure drop across the one or more filters is measured or sensed to determine when the filters should be cleaned or pulsed to keep them operating at or near peak efficiency or replaced. The pulsing is initially at a certain time interval but then the time interval can be automatically adjusted or varied as needed. That is the interval between successive pulses can become progressively shorter or longer by a selected time increment as needed. The interval is capable of being changed each cycle to keep the filter bank at or near optimum performance. Starting with clean filters, the intervals between pulses may over a period of time become progressively shorter or longer as needed so as to keep the filter at or near peak efficiency for as long a period of time as possible.

This pulsing feature of the invention is called "Progressive Sequential Pulsing" (PSP) which are trademarks of Binks Manufacturing Company. The advantages of Progressive Sequential Pulsing or PSP are: increasing filter cartridge life by eliminating unnecessary pulsing, pulsing occurring only when needed, reducing compressed air consumption need for pulsing, and alerting the operator prior to the need for filter cartridge changes. The Constant Air Flow Velocity Control and Progressive Sequential Pulsing features work together to provide an excellent controlled environment inside the booth and produce a more uniform environment, excellent control of airborne particulate, higher transfer efficiencies, reduced noise level, lower compressed air consumption for filter pulsing, longer filter media life, and better product finish.

Additionally, a warning device is provided so that, eventually, when the time interval between successive pulses becomes so short so as to indicate the filter can no longer be kept at or near peak efficiency merely by pulsing, but will need to be replaced in some time in the future, a signal or warning can be given. Preferably the signal would indicate that the filter be changed in the next 100 to 24 hours, say at 80 hours, and a warning may be given at some time later such as 24 hours or less before the filter must be changed. If desired the warning could also include shutting down of the booth.

An object of the present invention is to provide an air velocity sensing apparatus and method for a booth having airborne particulate, such as a paint booth.

Another object of the present invention is to provide an air velocity sensing apparatus and method for a paint particulate booth which can be used to regulate the booth's fan speeds.

Yet another object of the present invention is to provide an air velocity sensing apparatus and method which are reliable and not subject to variations over long periods of time of booth operation.

Still a further object of the present invention is to provide an air sensing apparatus and method for a paint or particulate booth which are not effected by conditions encountered during paint booth operation.

Yet a further object of the present invention is to provide an air velocity sensor for a paint or particulate booth which utilizes simple sail means for detecting the air velocity.

An additional primary object of the present invention is to provide a method and apparatus for pulsing the filter bank of a particulate booth to prolong the time between the installation and replacement of the filters.

A further object of the present invention is to provide a method and apparatus for pulsing filters in a particulate booth to keep the filters operating at or near peak efficiency for long periods of time.

Yet another object of the present invention is to provide a method and apparatus for progressively sequentially pulsing the filters of a particulate booth.

Still another object of the present invention is to provide a method and apparatus for altering or varying the time interval between pulses as needed from the time the filters are installed until the time they need to be replaced so as to keep them at or near optimum efficiency for as long as possible.

Still a further object of the present invention is to provide an alert and/or warning to change the filters before or at the time they can no longer be progressively pulsed to keep them at or near high efficiency levels.

These and other objects of the present invention will become apparent from the following written description and accompanying figures of the drawings.

DESCRIPTION OF THE PREFERRED EMBODIMENT

Figure 1:
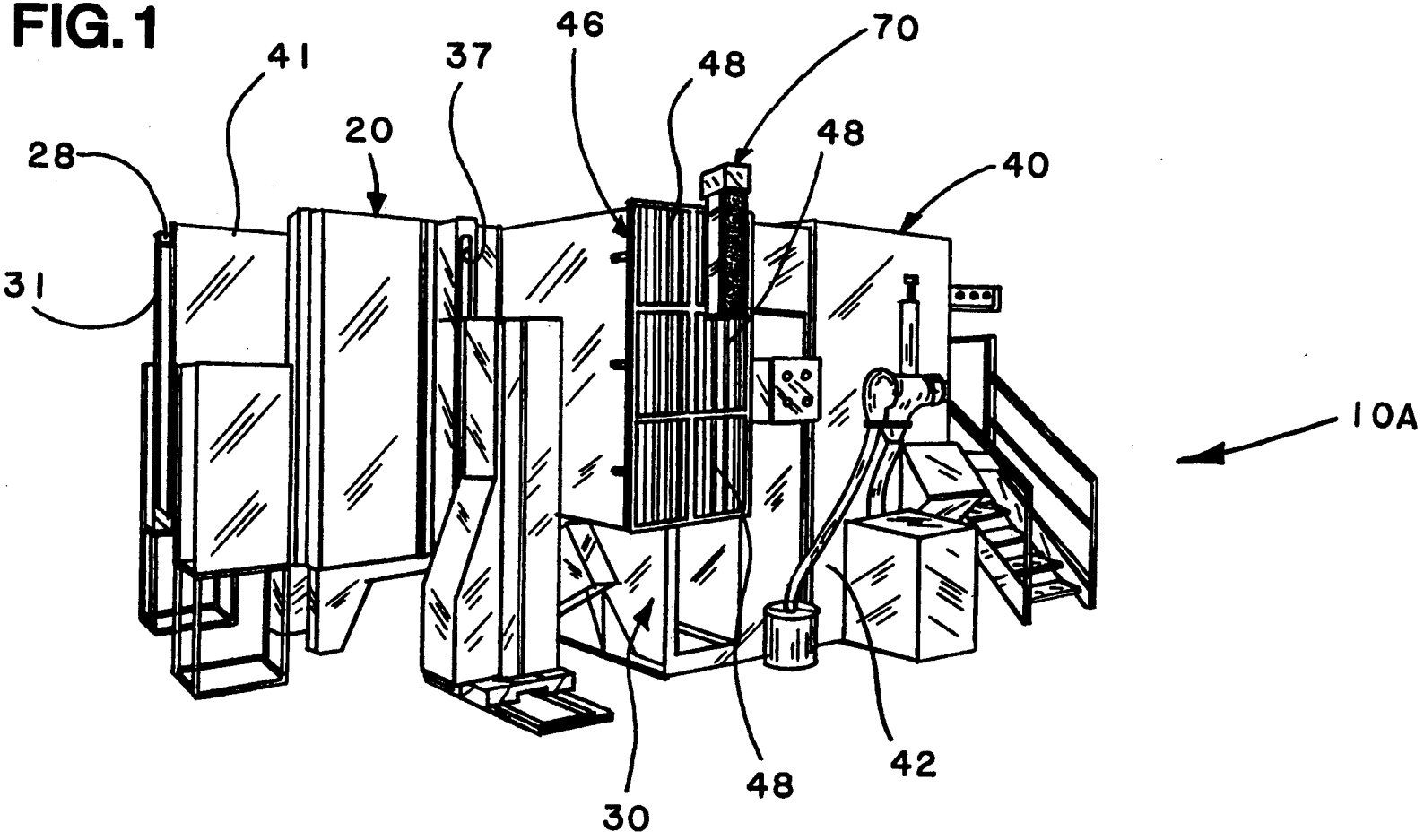
FIG. 1 is a perspective view of a paint booth, and in this instance a powder booth, utilizing the present invention.
Figure 2:
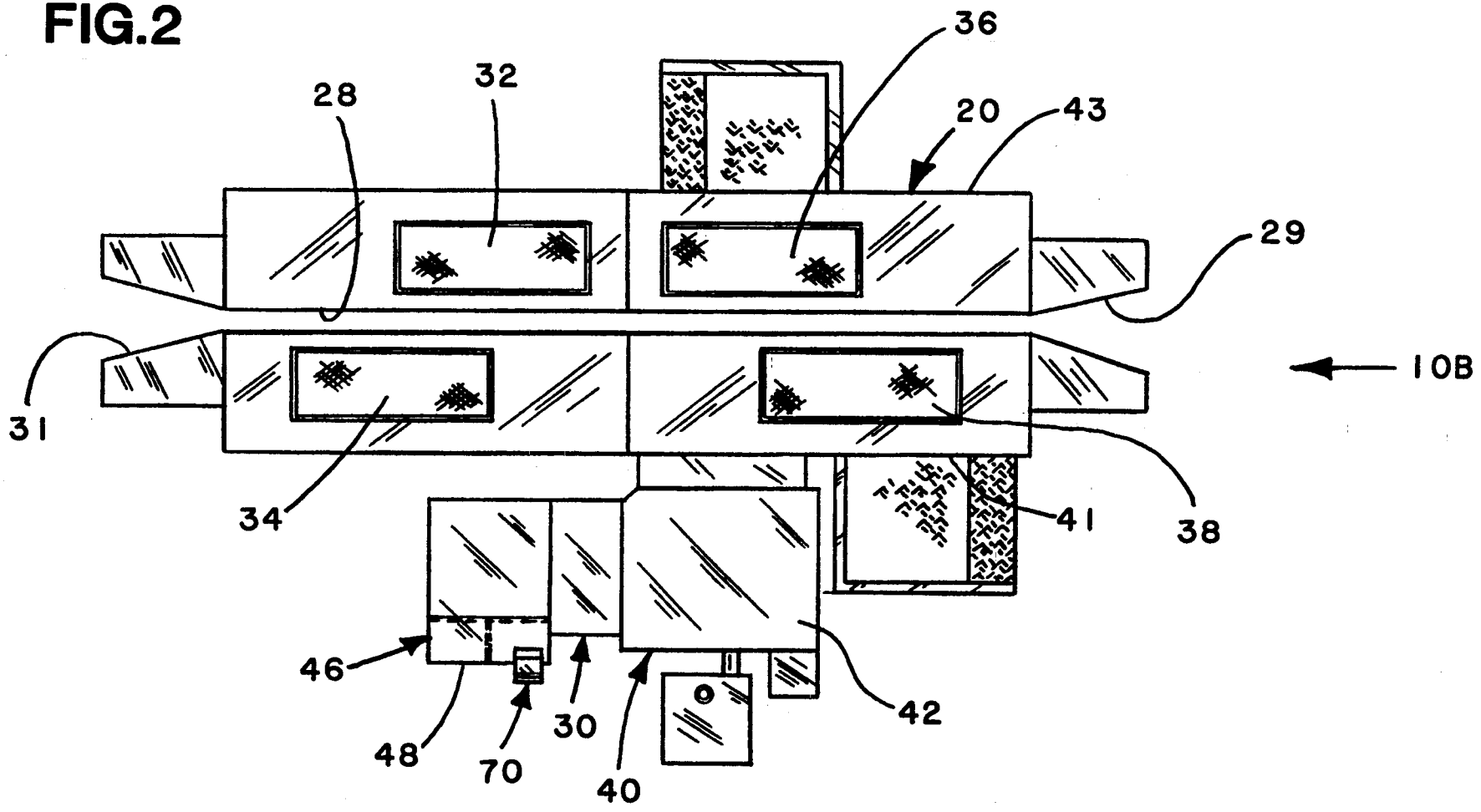
FIG. 2 is a plan view of a powder booth which is very similar to the booth depicted in FIG. 1.
Figure 3:
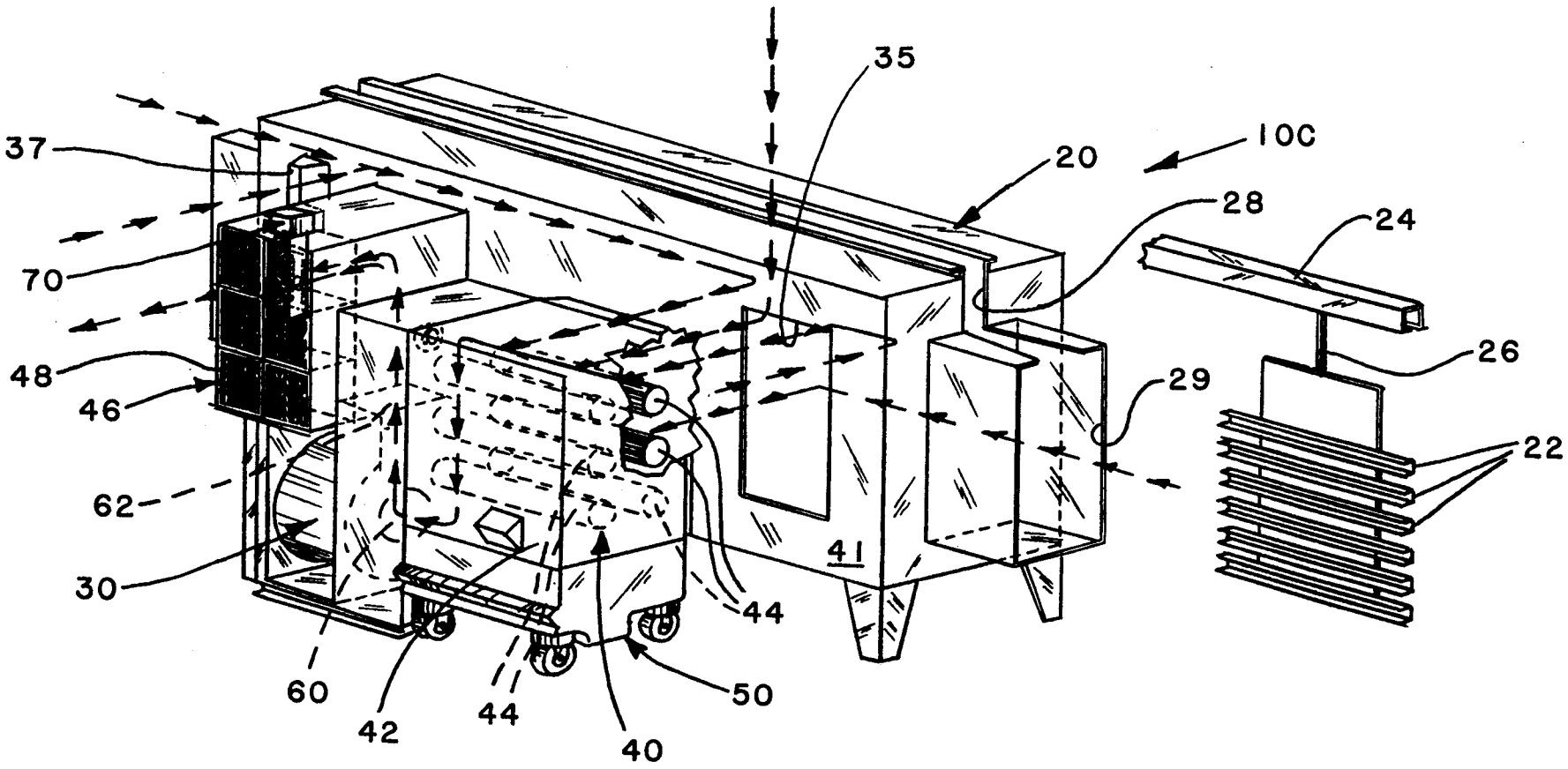
FIG. 3 is a perspective view of a powder booth, which depicts a booth very similar to those shown in FIGS. 1 and 2 with parts broken away to better show the airflow paths indicated by the streams of arrows.
Figure 4:
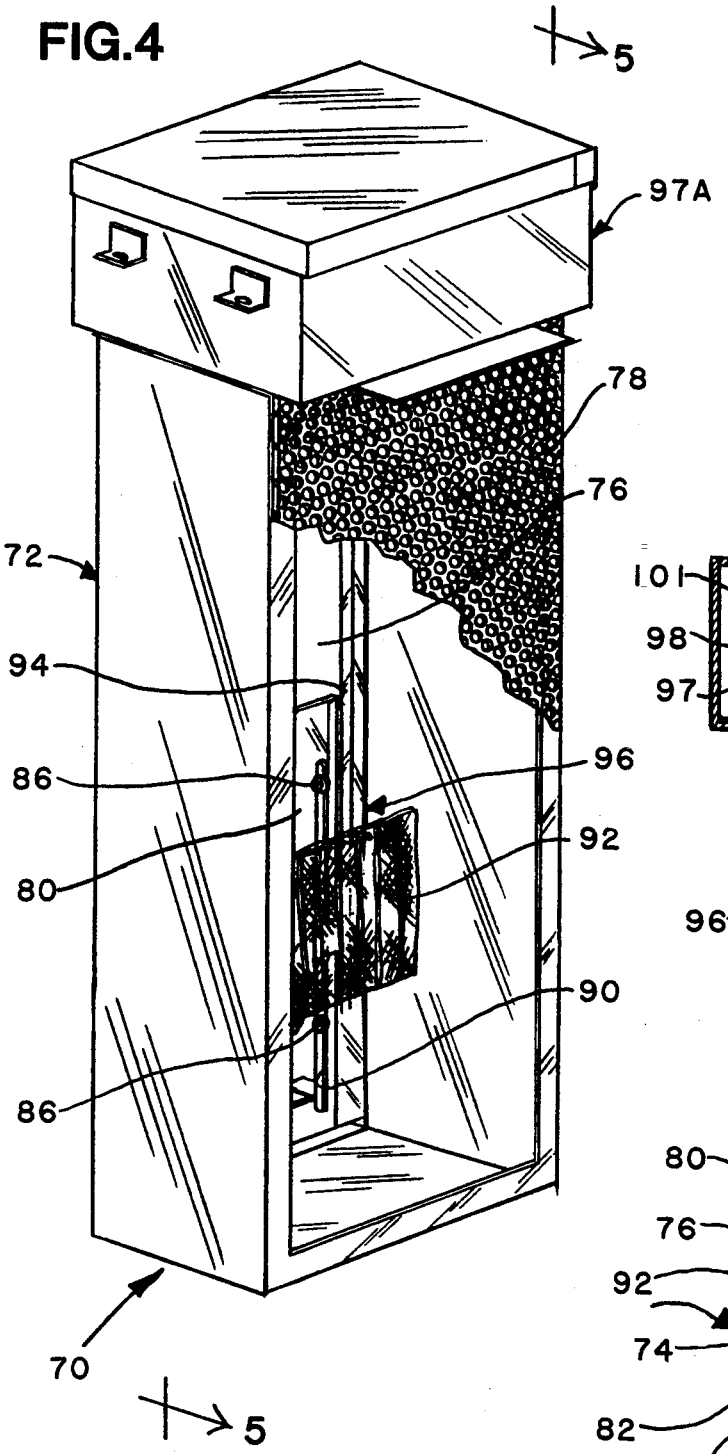
FIG. 4 is a perspective view of a portion of the constant air flow velocity detection mechanism shown in FIGS. 1–3 with a portion of the exterior broken away to better illustrate the interior.

Referring to FIGS. 1 to 3, particulate booths 10A, 10B, and 10C (herein collectively referred to as 10) are disclosed, and all are generally similar, as far as illustrating the present invention is concerned. In fact, each of these booths is a paint booth of the powder paint type. Each of the booths 10 has a work area or chamber 20 in which the articles 22 (FIG. 3) are to be worked upon, or in this instance, painted. As shown in FIG. 3, the articles 22 may be moved along on an overhead conveyor 24 and are carried on parts racks 26. As is shown, the booth 10A, B or C has a conveyor slot 28, and an article entrance 29 and an article exit 31 therein to accommodate the movement of the articles 22 and racks 26 therethrough. Of course the present invention is applicable to other type booths, such as work booths for sanding, grinding or any other type activity wherein particulate matter, such as dust or droplets are generated, and would also include liquid paint spray, as opposed to powder paint type booths.

Referring to FIG. 2, the booth 10B shows, in this instance, four painting stations, two of which (32 and 34) may be for automatic painting equipment and two (36 and 38) of which may be for manual painting (painters). Of course, the invention is usable in any other booth painting or work arrangements. As is shown, each of the booths 10 has means for moving air through the work chamber 20 in the form of a blower or fan 30. While preferably the fan 30 is on the downstream side of the work chamber 20, it could also be located on the upstream side of the work chamber. As is shown in FIG. 3, the booths 10 have filter means 40 comprising a first or primary filter bank 42 comprising a plurality of conventional cartridge filters 44 which are located downstream of the work chamber 20. Adjacent the primary filter bank 42 is a secondary filter 46 or final filter comprising a plurality of filter screens 48 downstream of the primary filter bank 42 and also of the fan or blower 30.

As these booths 10 are powder booths, they have a changeable and/or removable powder recovery bin 50 (FIG. 3) located beneath the cartridge filters 44 to capture the powder trapped and recovered by the cartridge filters 44, as is conventional.

As is apparent from FIG. 3, when the fan or blower 30 is operated and as shown by the streams of arrows, air is drawn in through the top slot 28, the article entrance 29, the article exit 31 of work chamber 20, through manual painter access opening 35 and operating or hose opening 37 in the side wall 41 of the work chamber. From there the air is used in the work chamber 20 to control overspray and/or the movement of generated particulate and is drawn off by the blower 30 into the primary filter bank 42. The air is then pulled by the blower 30 through and into the hollow centers of the plurality of filters cartridges 44 with the dust or powder first collecting on the outside surfaces of these cartridges 44. The air discharged from the interior of the cartridges 44, nearly fully cleaned, then enters the fan inlet 60 (see FIG. 3), moves through the fan 30, is discharged from the fan outlet 62 and through the final filter screens 48. Discharging the air out the final filter screens 48 both cleans the air again and reduces any blower noise to an acceptable level. The entire operation described in this paragraph is well known and conventional but is described by way of background for a full understanding of the invention.

As is apparent, the cross-sectional area of the work chamber 20 is considerably larger than the cross-sectional area for the final filters 46. As the quantity of air flowing through both is generally the same, the velocity of the air flow from the final filters 46 is proportional to but at a considerably higher velocity than the velocity of the air flowing in the work chamber 20. Thus, it is possible to measure the higher velocity of the air flowing from the final filter 46, and that velocity will be generally proportional to the velocity of the air flow in the work chamber 20. Likewise, if the velocity of the air at the discharge of the final filter 46 can be held constant, then generally the velocity of the air in the work chamber 20 will also be held constant. Advantage is taken of these above principles by detecting and holding constant the velocity of the cleansed air flow at the discharge of the final filters 46, in order to achieve an essentially constant velocity of air flow in the work chamber 20. Such construction has the advantage of avoiding possible contamination of the air velocity control device and also the advantage of detecting the relatively larger changes of velocity which occur after the final filter as compared to in the work chamber so that it is easier to maintain a constant velocity in the latter. The matters described above in this paragraph are also known in the prior art, but are again described by way of background so at to better understand the ,present invention.

Figure 5:
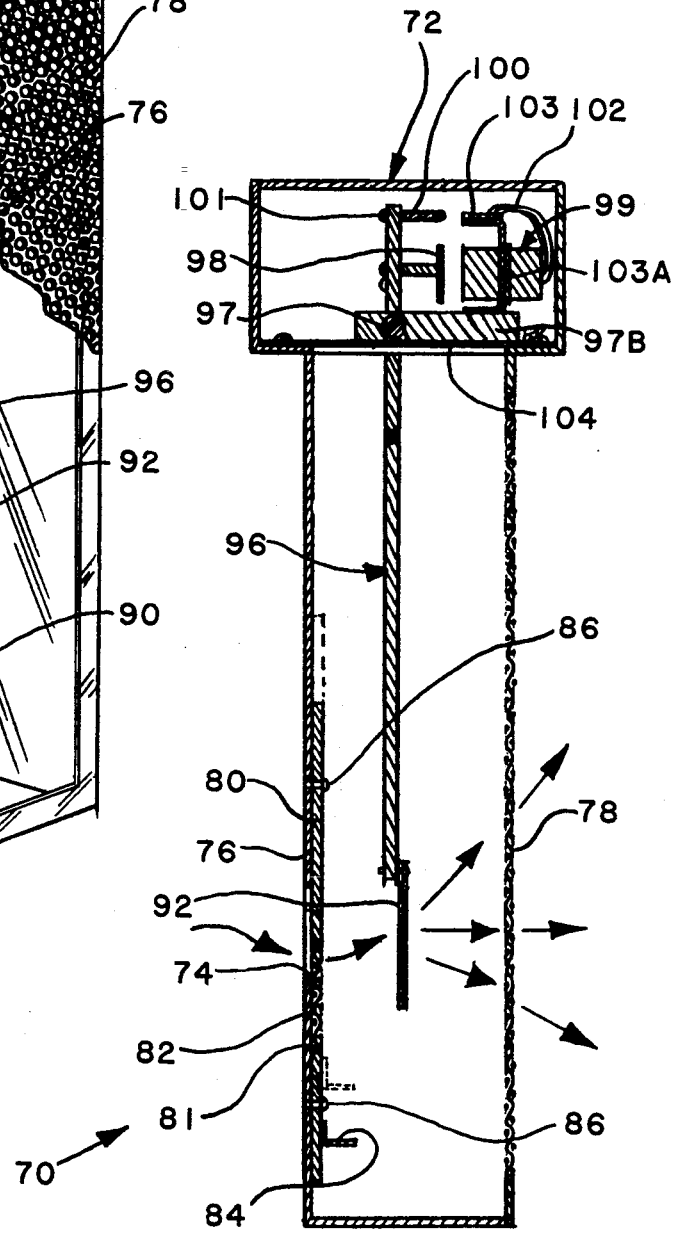
FIG. 5 is a cross-sectional view taken along the lines 5—5 of FIG. 4.
Figure 6:
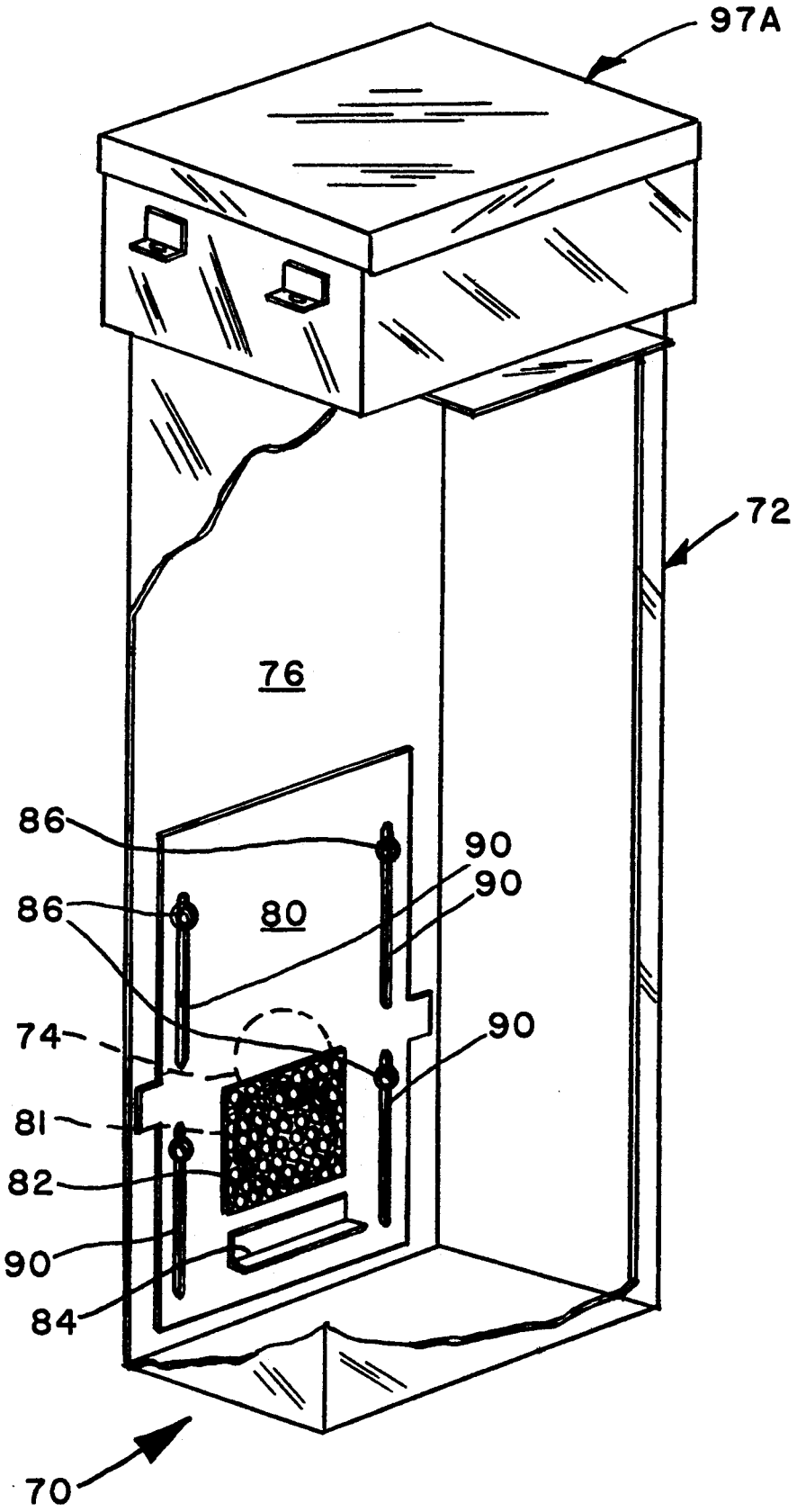
FIG. 6 is a perspective view of the enclosure of the mechanism of FIGS. 4 and 5 with a portion of the enclosure cut away and other portions removed.

Referring to FIGS. 4 to 7, a preferred form of velocity control means 70 for increasing the air velocity is shown. As can be seen in FIGS. 1 to 3, means 70 is secured by any conventional means and positioned on the booths 10 to measure the air flow as it is discharged from the final filters 46. Means 70 comprises a rectangular housing 72 providing an air path therethrough with an entrance 74 (FIG. 5) in a wall 76 adjacent the discharge of the final filter 46 and an exit in the form of a screened door 78 on the opposite wall. As is shown in FIGS. 5 and 6 the entrance 74 may be partially closed off by a sliding adjustment plate 80 which has an opening 81 therethrough covered by a screen 82. The plate 80 may be put in any desired or required position to either leave the entrance 74 fully open or almost fully closed. Adjustment of the plate 80 is made to compensate for any unusually high or low air flow velocities at this sight to make the air flow velocity thereafter compatible with the remainder of the velocity detecting device or means 70. The plate 80 can be moved to any such desired position by manipulating its handle 84 and is held in the desired position by tightening the plurality screws 86. The four screws 86 engage threaded openings in the back wall 76 of the housing 72 and slide in elongated slots 90 formed in the plate 80 to accommodate and guide movement of the plate. When tightened the screws 86 hold the plate 80 tight to the wall 76. A screen, like screen 82, could have also been mounted over the opening 74, but in this instance was secured, as say by spot welding, over the opening 81, and functions to dampen any blower or fan pulsations, which might otherwise effect the air velocity readings. The handle 84 could also be fastened by any conventional means to the plate 80, say as by spot welding.

Referring back to FIGS. 4 and 5, the air admitted through the variable size opening formed by the relative positions of openings 74 and 81, generally blows against a rectangular sail 92 which fits close to but does not touch the walls of the housing 72. The sail 92 is formed from a screen material, which can be identical or somewhat similar to screen 82, which will further contribute to the dampening of any blower or fan pulsations. The sail 92 is secured by any conventional means, such as mechanical interlock, screws, welding, rivets, etc. to the bottom of an elongated rod 94 forming sail- pendulum means 96. This pendulum-sail assembly 96 is mounted for movement around an upper pivoting axis or rod 97 (FIGS. 5 or 7), within an upper rectangular portion 97A of the housing 72 to respond to the air flow flowing from the booth through the inlet opening 74–81. The outer ends of the rod 97 may be suitably mounted in a "U" shaped member 96B in bearings such as ball or roller bearings to reduce friction. The ends of the pivot rod 97 can be located by stops such as sleeves 95 (FIG. 7) secured thereto as by set screws. At its upper end, close to the pivot rod or point 97, the pendulum carries on an element secured to the pendulum 96 as by a screw, a circular metallic disk 98. This disk 98 can be moved within the magnetic flux field of an inductive electronic transducer 99. This transducer is a Model #IWA 30 U 9001 manufactured by Baumer Electric of Fraun Feld, Switzerland.

Figure 7:
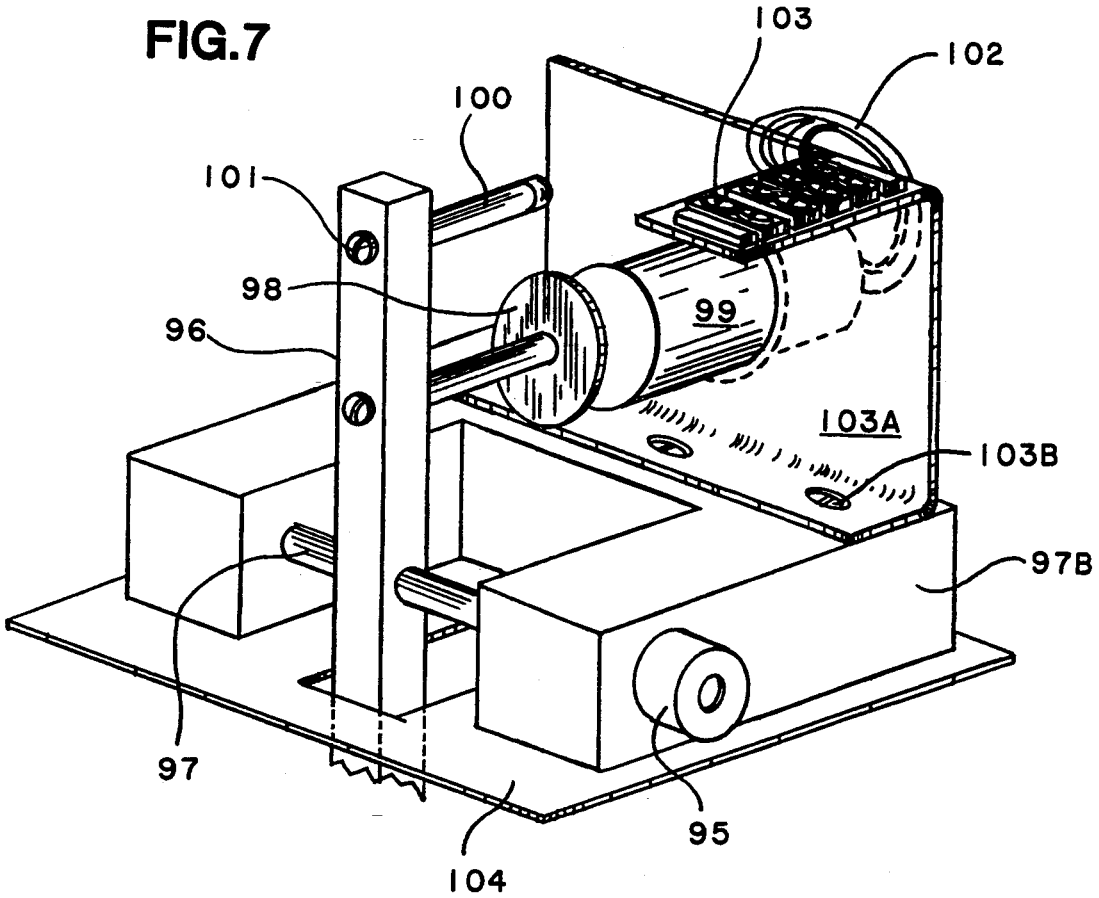
FIG. 7 is an enlarged perspective view of the proximity sensor portion which is located at the upper end of the enclosure shown in FIGS. 4 to 6.

This metallic disk 98 and transducer 99 are shown in FIGS. 5 and 7 in the upper portion of the housing 72, this upper portion 97A of the housing being separated from the lower sail enclosing portion by a baffle plate 104. The baffle plate 104 carries the "U" shaped member 97B, isolates the sensor from the air flow velocity below, and reduce the possibility of any paint ladened contaminates affecting the sensitivity and accuracy of the transducer 99 over long periods of time.

Figure 9:
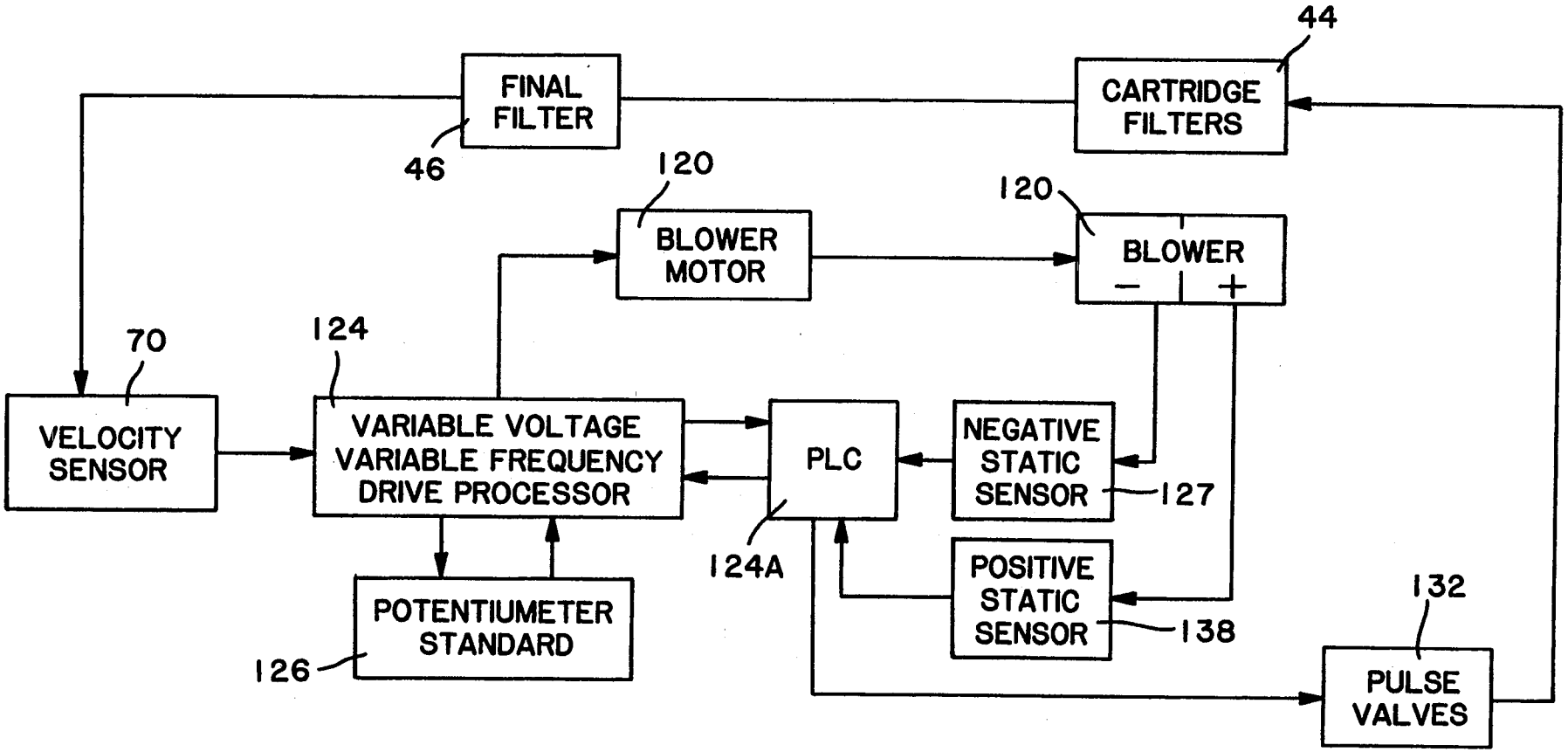
FIG. 9 is a schematic of the constant velocity and progressive pulsing features of the present invention for use with any of the booths of FIGS. 1 to 3.

To maintain the metallic disk 98 within the linear range of the transducer 99, a counterbalance 100 is provided and is similarly mounted to the pendulum 96, as by a screw 101, as is the disk 98. As is shown for convenience the wires 102 for the transducer 99 can be connected to a terminal strip 103 carried on a bracket 103A secured as by screws 103B to the "U" shaped member 97B. The transducer will be connected as by the terminal strip 103 to the variable frequency drive as shown in FIG. 9. The bracket 103A also mounts the transducer 99. For convenient access the top of the portion 97A can be hinged to open.

As can be appreciated as the sail 92 moves downstream with increased air flow velocity, the disk 98 moves further away from the sensor 99, which within a limited range gives a linear signal denoting the sail has sensed an increase in air velocity. Of course, the pivot point 97 of the pendulum could be arranged above the disk 99. This linear signal denoting increased velocity is to be compared to a standard signal, such as determined by a potentiometer (see 126 in FIG. 9). The potentiometer signal represents the desired velocity, and if the sensed signal is the same the fan or blower is to be maintained at its present speed. If the sensed signal was above or below the potentiometer signal the fan or blower speed could be appropriately adjusted to attain the desired constant air flow velocity. This control of the blower or fan and comparison to the standard (potentiometer signal) can be accomplished with a variable speed motor controller, or alternatively with a conventional programmable logic control (PLC). See 124 or 124A in FIG. 9. The variable speed drive or PLC in response thereto either slows down or speeds up the blower drive and in turn the blower so that the air velocity being sensed will be decreased or increased to achieve and maintain the desired constant velocity and the blower at the lowest speed needed to achieve the desired velocity. While desired velocities will vary with type of installation and materials being used, a suitable range of the desired work chamber air velocity for powder painting might be somewhere between 60 feet per minute and 150 feet per minute. These work chamber velocities may result in a sensed air velocity at means 70 of say 180 to 450 feet per minute.

Figure 8:
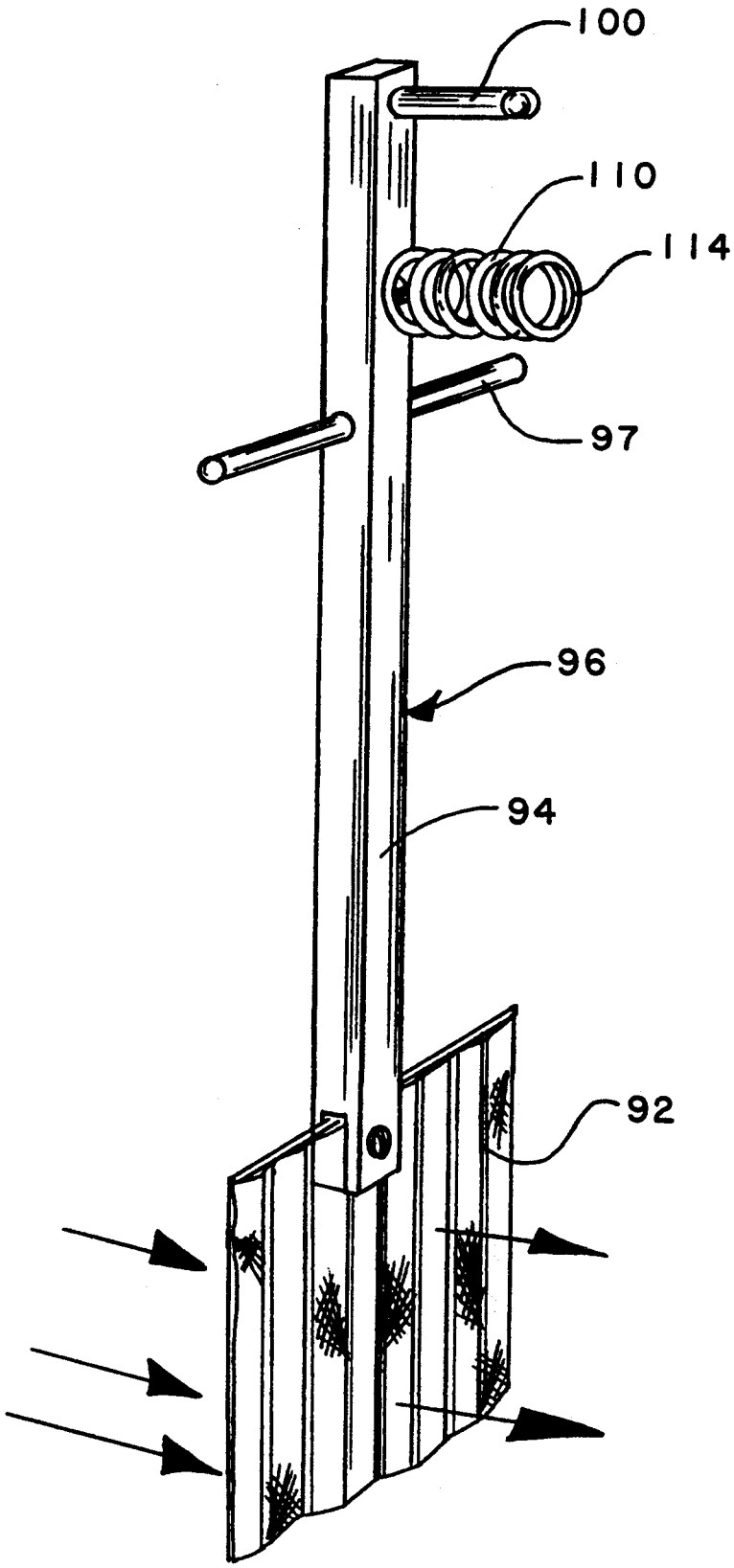
FIG. 8 is a perspective view of portions of an alternative embodiment.

Referring to FIG. 8, an alternative arrangement for a part of the velocity sensor is shown. The sail pendulum assembly of FIG. 8 is generally similar to that of FIGS. 4 to 7, but includes a biasing spring 110 to help maintain the sail-pendulum within a linear operating range, the spring preventing excessive movement of the sail-pendulum out of the proximity sensor's linear range. This spring 110 provides resistance to movement and will shorten the magnitude of the sail's response to changes in air velocity. If desired, adjustment means can be provided to change the preload or bias of the spring 110 as by providing an adjustable mount for the end 114 of the spring, as is mechanically well known.

Referring to FIG. 9, a schematic of the progressive sequential pulsing and constant velocity features is shown. As is shown the blower 120 is driven by a blower motor 122 of the variable speed type. The blower motor 122 is operated by a variable voltage, variable frequency drive processor 124. The potentiometer 126 for establishing the signal standard (say 2.5 volts which might represent a velocity of 100 ft/min in the work chamber and 200 ft./min. at the sensor 70 against which the sensed velocity is measured) is inputed into, in this instance the variable speed drive 124. In turn the variable speed drive unit provides the potentiometer with a standard voltage supply, of say 10 volts. The velocity sensor 70 sends an output signal to the variable speed drive 124, wherein it is compared with the standard signal set on the potentiometer 126, as heretofore described. As in this instance the variable speed drive 124 used did not have sufficient input variables to carry all its other functions related to the booth operations, such as paint or spray gun status, conveyor status, powder level, etc., the additional programmable logic controller (PLC) 124A is provided to add input capacity. This PLC 124A integrates the progressive pulsing feature into the variable speed blower drive 124.

In progressive sequential pulsing the pressure drop across the cartridge filter 44 is measured by a negative static pressure transducer 127. In this instance when this pressure drop is from 0 to 3½ inches of water pressure, no pulsing occurs as that represents reasonably good cartridge conditions. When this pressure falls within the range of 3½ to 4½ inches of water pressure, the progressive pulsing feature is activated. In the disclosed installation a 3½ inch pressure drop is indicative of a blower speed of about 1,200 rpm, while the 4½ inch pressure is indicative of about 1,700 rpm blower speed. The PLC is programmed to periodically test the static pressure drop across the cartridge filters 44 and then selects from initially inputed values an appropriate time period to operate the cartridge pulsing valves 132. When the pulsing valves 132 are pulsed, a pulse of compressed air pulses the cartridge filters 44. This initial period is selected say at 2 minutes, i.e. the cartridges are to be pulsed in 2 minutes. If the cartridges show an acceptable pressure drop, the next time the interval between pulses is increased by say 15 seconds (to 2 minutes, 15 seconds). If on the other hand, the pressure differential increases the next time the pulsing interval is decreased say 15 seconds (to 1 minutes, 45 seconds). The increases and decreases take place after each testing period. Normally there is little reason for the pulsing interval to exceed the initial pulsing figure for brand new filters. Slowly as the conditions of the new filters deteriorate due to clogging, even with intermittent pulsing, the filters reach a point where the pressure differential is so large it is known that additional pulsing will no longer restore the cartridge filters. This point is approximately when the interval between pulses has decreased to 30 seconds, indicating a minimum acceptable pulsing time has been reached. At this point a warning or alert can be given. In this instance, these warnings or alerts are generated by a positive static pressure sensor 138. That is when sensor 138 detects a positive static pressure of between 1½ to 2 inches of water (above atmosphere), that indicates the cartridge filters are sufficiently clogged that pulsing will no longer restore filter efficiency and a warning is given to change the filters, say with the next 80 hours.

Both the negative pressure sensor 127 and the positive pressure sensor 138 operate independently of the progressive pulsing program and in effect provide envelopes within which the progressive pulsing feature operates. That is whenever the pressure is inside the envelop provided by upper and lower limits of positive and negative pressure the progressive pulsing interval is being either increased or decreased by the desired or selected additional interval (say the 15 seconds period referred to above).

Of course, other initial time intervals and increasing or decreasing time intervals could have be chosen. Also while separate negative and positive static pressure sensors 127 and 138 were provided, blower or blower motor speed could have instead been sensed to determine the operating envelope within which to use the progressive pulsing.

To summarize, in progressive sequential pulsing the static pressure drop across the filter bank is sensed and when it reaches a sufficiently high magnitude that triggers through the PLC the initiation of progressive sequential pulsing of the filter bank to return it to its former high efficiency. The PLC is programmed to keep track of and monitor the intervals between pulses. Should the intervals remain constant the pulses would remain at essentially the same time interval and or increase in interval to minimize the amount of pulsing. Should on the other hand the time intervals between pulses decrease and not yet be able to maintain the filter bank's efficiency, the pulsing interval would be further shortened and again tested until the pulsing occurs at a short enough interval to provide a minimum acceptable pressure drop. Should it be determined that the pulsing interval has already been shortened to the minimum possible time interval that filter efficiency can not be prolonged much longer by pulsing, a signal can be given such as to replace the filters within 100 to 24 hours, say at 80 hours, and/or at a later time a second warning given which may alert the operator that the booth should be soon shut down and the filters changed and/or even shutting down the booth until the filters are changed.

While the preferred embodiments of the apparatus and method of the present invention have been illustrated and described, it should be understood that equivalent elements, structures and steps and modifications thereof fall within the scope of the following claims.

What is claimed is:

1. A particulate booth having generated airborne particulate matter therein, comprising a work chamber wherein the airborne particulate matter is generated, blower means for moving air through the work chamber, means for determining the velocity of the air moving through the work chamber, means for controlling the blower means for moving the air through the work chamber to provide a constant velocity of air in the work chamber, said means for determining the velocity of the air moving through the work chamber including sail means movable by the moving air and sensor means for detecting the movement of said sail means, at leat one particulate filter located downstream of said work chamber, said means for determining the velocity of air being located and measuring the velocity of the air after it is discharged from said at least one particulate filter, said sensor means generating a signal for regulating said blower means for moving the air, said sensor means including a linear proximity detector for detecting the motion of said sail means, said means for controlling the blower means for moving the air through the work chamber including standard means for comparing with said signal from said sensor means, and said means for controlling the blower means for moving air maintaining said blower means at the lowest rotating speed to maintain the desired constant air flow velocity in said work chamber to compensate for any diminishment of air to flow through said particulate filter due to clogging, and said means for determining the velocity of air being located at and detecting the velocity of the air discharged from said work chamber without being subject to contamination of particulate matter in the work chamber, whereby a constant velocity air flow can be provided in the work chamber.

2. A particulate booth as in claim 1, wherein said particulate filter includes at least a first filter and a second filter in series with said first filter, said air first passing through said first filter and then said second filter, said means for determining the velocity of air being located at and detecting the velocity of the air after it is discharged from said second filter.

3. A particulate booth as in claim 1, wherein said mean for determining the velocity of air includes pendulum means carrying said sail means.

4. A particulate booth as in claim 1, further comprising means for progressively sequentially pulsing the filter means to keep the filter means operating at a substantial efficiency level.

5. A particulate booth as in claim 4, wherein said pulsing occurs at time intervals of generally shorter durations until the filter means needs to be replaced.

6. A painting booth having generated airborne paint particulate matter therein, comprises a painting chamber wherein the airborne paint particulate matter is generated, rotating blower means for moving air through the painting chamber means for determining the velocity of the air moving through the painting chamber, means for controlling the rotating blower means for moving the air through the painting chamber to provide a constant velocity of air in the painting chamber for uniform control of the airborne paint particulate matter in said painting chamber, said means for determining the velocity of the air moving through the painting chamber including sail means movable by the moving air, sensor means for detecting the movement of said sail means, said means for determining the velocity of air including pendulum means carrying said sail means, at least on particulate filter located adjacent and downstream of said painting chamber, said means for determining the velocity of air being in located and measuring the velocity of the air after it is discharged from said at least one particulate filter, said sensor means generating a signal for regulating said rotating blower means for moving the air, said sensor means being a proximity detector for detecting the motion of said sail means, said means for controlling the rotating blower means for moving the air through the work chamber including adjustable standard means for comparing with said signal from said sensor means, means for progressively sequentially pulsing the filter means to keep the filter means operating at a substantial efficiency level, said pulsing occurs at time intervals of generally shorter durations until the filter means needs to be replaced, and means for controlling the rotating blower means for moving air maintains said rotating blower means at the lowest rotating speed to maintain the desired constant air flow velocity in said painting chamber, whereby a constant velocity air flow can be provided in said painting chamber for uniform control of the airborne paint particulate in said painting chamber.

* * * * *